US007069995B2

(12) United States Patent
Chan et al.

(10) Patent No.: US 7,069,995 B2
(45) Date of Patent: Jul. 4, 2006

(54) REMEDIAL SYSTEM TO FLUSH CONTAMINANTS FROM TUBING STRING

(75) Inventors: Kwong-Onn C. Chan, Edmonton (CA); David J. Sedgwick, Sherwood Park (CA); David Comeaux, Houston, TX (US); John Murphy, Marrero, LA (US)

(73) Assignee: Vetco Gray Inc., Houston, TX (US)

( * ) Notice: Subject to any disclaimer, the term of this patent is extended or adjusted under 35 U.S.C. 154(b) by 211 days.

(21) Appl. No.: 10/825,260

(22) Filed: Apr. 15, 2004

(65) Prior Publication Data

US 2004/0206508 A1 Oct. 21, 2004

Related U.S. Application Data

(60) Provisional application No. 60/463,223, filed on Apr. 16, 2003.

(51) Int. Cl.
*E21B 37/00* (2006.01)
*E21B 33/03* (2006.01)
*E21B 21/00* (2006.01)

(52) U.S. Cl. ..... 166/312; 166/90.1; 166/242.2

(58) Field of Classification Search ..... 166/312, 166/90.1, 242.2, 222, 223
See application file for complete search history.

(56) References Cited

U.S. PATENT DOCUMENTS 4,450,907 A * 5/1984 Clark et al. ..... 166/223
4,972,904 A * 11/1990 Godare ..... 166/90.1
5,154,588 A * 10/1992 Freet et al. ..... 417/423.3
5,927,405 A 7/1999 Monjure et al.
6,186,239 B1 2/2001 Monjure et al.
6,289,992 B1 9/2001 Monjure et al.
6,352,113 B1 * 3/2002 Neuroth ..... 166/301

* cited by examiner

*Primary Examiner*—David Bagnell
*Assistant Examiner*—Shane Bomar
(74) *Attorney, Agent, or Firm*—Bracewell & Giuliani LLP

(57) ABSTRACT

A method of cleaning debris from a string of production tubing in a well enables removal without pulling the string of rods that extend through the tubing. A rotary pump is suspended to a lower end of the tubing for pumping well fluid through the tubing to a wellhead at the surface. A motor assembly at the surface rotates the rods to drive the pump. A closure member is placed on a lower end of an elastomeric hose that will open when a selected level of internal fluid pressure is applied. The operator applies internal pressure to the hose at a pressure less than the selected level to increase rigidity of the hose. The operator inserts the hose through a port in a sidewall of the wellhead, the hose deflecting downward and into the tubing. At a desired point, the operator increases the internal pressure in the hose to open the closure member, then discharges a cleansing fluid into the tubing, which flows back up the tubing along with debris.

9 Claims, 2 Drawing Sheets

REMEDIAL SYSTEM TO FLUSH CONTAMINANTS FROM TUBING STRING

This application claims the priority of provisional application Ser. No. 60/463,223, filed Apr. 16, 2003, entitled "Remedial System to Flush Contaminants From a Tubing String".

FIELD OF THE INVENTION

This invention relates in general to oil well production, and in particular to a system using an elastomeric hose for insertion into a tubing string to remove contaminants.

BACKGROUND OF THE INVENTION

One type of well has part of a rotary pump, such as a progressive cavity pump stator, secured to a lower end of a string of tubing. The tubing is located within casing, and the upper end of the tubing is supported in a wellhead at the surface. A motor assembly located at the surface is coupled to a string of rods that lead through the tubing. A rotor on the lower end of the rods fits within the pump stator. The motor assembly rotates the rods and the rotor to cause the pump to deliver well fluid up the tubing to the surface. These wells are usually shallow, and the well fluid is typically viscous oil.

In some wells, debris such as sand flows from the earth formation into the pump. The sand tends to settle and accumulate in the tubing above the pump. This accumulation restricts the passage of well fluid to the surface.

Various techniques are used to reduce sand flowing from the formation, but often some sand will still accumulate in the tubing. Also, a sand cleaning procedure utilizing coiled tubing is known. In this procedure, the operator disconnects the motor assembly, which is usually a top drive mounted on top of the wellhead assembly. The operator then uses a coiled tubing injector to push coiled tubing down the tubing alongside the rods. The coiled tubing is a continuous steel pipe that winds onto a large portable reel. The operator pushes the open lower end of the coiled tubing into the sand accumulation and pumps water down the coiled tubing. The water flows back up the coiled tubing, along with sand. While this technique is workable, pulling the top drive motor assembly is time consuming.

SUMMARY OF THE INVENTION

A method of treating a well is provided with this invention. A string of production tubing is suspended within casing in a well. A pump is located at a lower end of the tubing for pumping well fluid through the tubing to a wellhead at the surface. A closure member is connected to a lower end of an elastomeric hose, and the hose is inserted though a port in a sidewall of the wellhead. The operator pumps a fluid into the hose with the lower end closed to make the hose more rigid. The end of the hose assembly deflects downward from the port into the upper end of the tubing.

The operator pushes the hose downward in the tubing while maintaining internal pressure in the hose and the lower end of the hose closed. At a desired point, the operator increases the internal pressure in the hose to a level sufficient to cause the lower end of the hose to open, thereby discharging the cleansing fluid into the tubing. The cleansing fluid flows back up the tubing to the surface along with debris.

DETAILED DESCRIPTION OF THE PREFERRED EMBODIMENT

Figure 1:
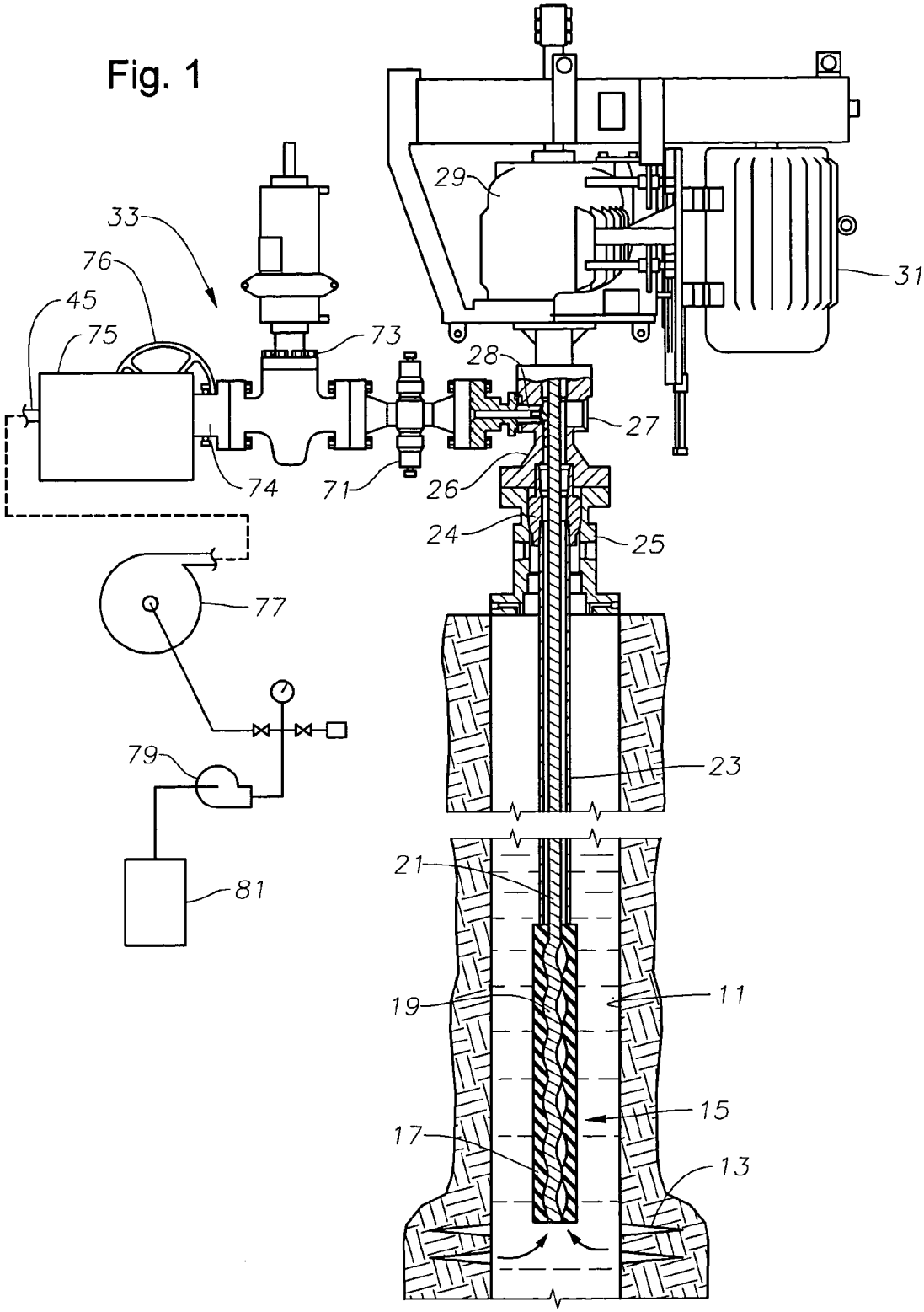
FIG. 1 is a partially schematic sectional view of a progressive cavity pump system for a well with a flushing device mounted to the wellhead in accordance with this invention.

Referring to FIG. 1, a well has a casing 11 with perforations 13 to enable well fluid to flow into casing 11. A conventional progressive cavity pump 15 is shown suspended in casing 11 for pumping the well fluid to the surface. Pump 15 includes a stator 17 that comprises a stationary housing having an elastomeric interior. The elastomeric interior is formed with helical cavities. A metal rotor 19 is located inside stator 17 and rotated to cause fluid to pump through progressive cavity pump 15. Rotor 19 has a helical exterior.

In this embodiment, rotor 19 is rotated by a string of sucker rods 21 that extend to the surface through a string of production tubing 23. Tubing 23 is suspended on a tubing hanger 24 landed in a tubing head 25. A blowout preventer 26 mounts on top of tubing head 25, the two components forming a wellhead for the well. Blowout preventer 26 comprises a tubular housing, typically with a manually operable set of rams that will close around rods 21 in the event of an emergency. Blowout preventer 26 has a lateral flow outlet 27 extending through the sidewall of blowout preventer 26 perpendicular to the axis of tubing 23. The well fluid being pumped by progressive cavity pump 15 flows up tubing 23 and out lateral flow outlet 27 of blowout preventer 26. Another port 28, which is normally closed, extends laterally through the sidewall of blowout preventer 26. Tubing head 25 and blowout preventer 26 are permanent parts of the wellhead assembly.

A top drive assembly mounts to the upper end of blowout preventer 26 for rotating rods 21. The drive assembly includes a gear box 29 that reduces the speed of rotation of an electrical motor 31. The string of rods 21 extend through tubing head 25, blowout preventer 26 and are coupled to gear box 29.

Figure 2:
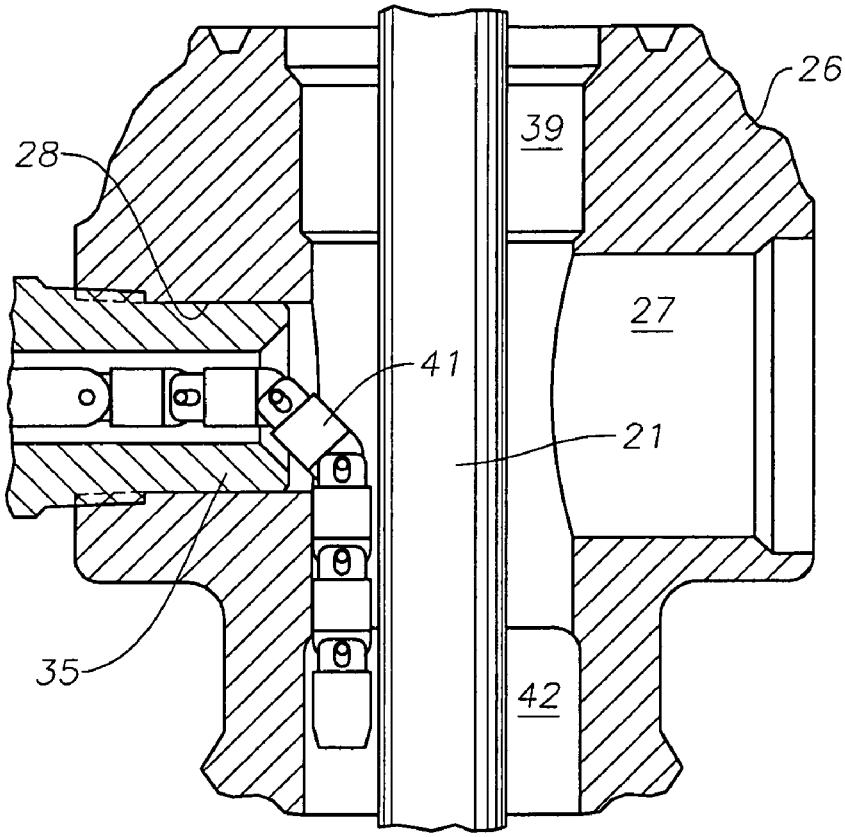
FIG. 2 is an enlarged view of a portion of the wellhead of FIG. 1, showing the articulated weight bars being lowered into the tubing.

In many wells, sand and debris are produced along with well fluid. The sand accumulates in and above pump 15, reducing the flow rate. An injector assembly 33 is shown mounted to blowout preventer 26 for use in flushing contaminants such as sand from pump 15 and tubing 23. Injector assembly 33 has a nipple 35 (FIG. 2) that connects to port 28 in blowout preventer 26. Port 28, like flow passage 27, is perpendicular to an axial bore 39 extending through blowout preventer 26, however it could downward and inward to bore 39 at a selected angle less than 90 degrees. The upper end of the string of rods 21 extends coaxially through axial bore 39.

An articulated set of weight bars 41 is shown being inserted through nipple 35 into axial bore 39. Each segment of weight bars 41 is secured to adjacent weight bars 41 by pins that allow the weight bars 41 to pivot relative to each other in one plane. The articulation of weight bars 41 allows them to turn from horizontal while in nipple 35 to vertical when entering bore 39.

Figure 3:
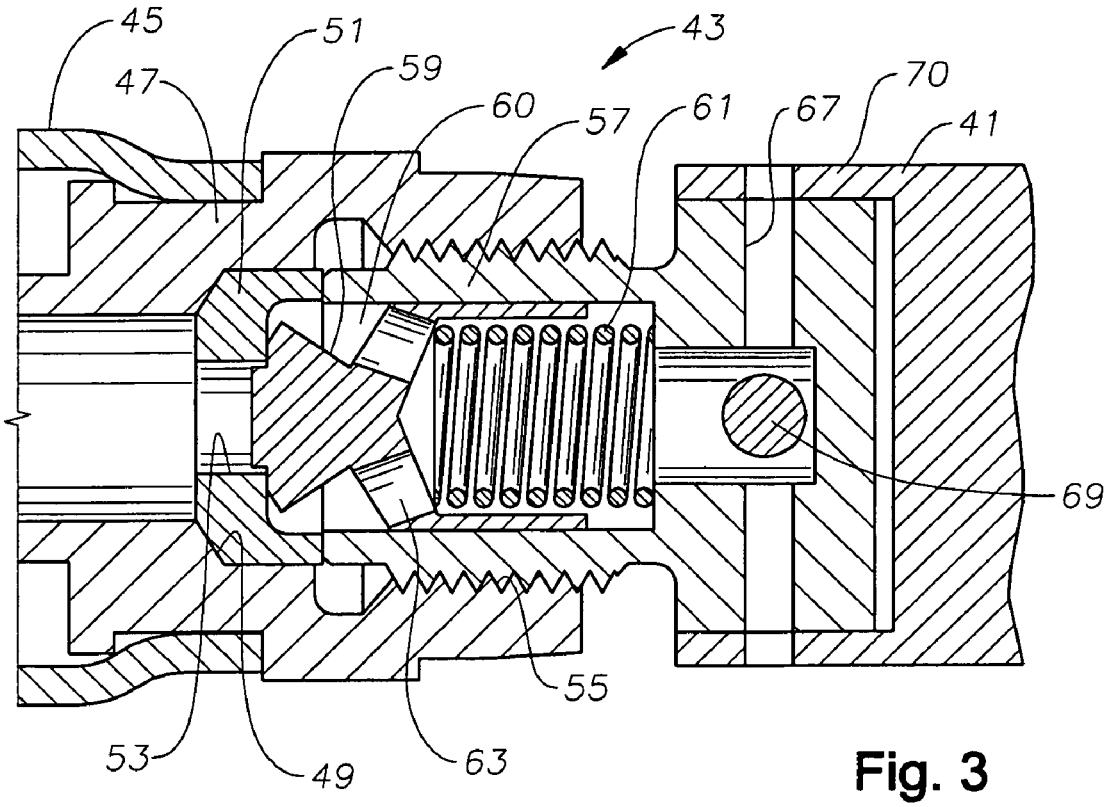
FIG. 3 is an enlarged view of a nozzle for the hose utilized in the system of FIG. 1.

A combination valve and nozzle 43 is shown schematically in FIG. 3. The configuration of nozzle 43 could vary considerably. In this example, nozzle 43 is secured to the end of a hose 45 that is preferably elastomeric and flexible. Nozzle 43 has a body 47 onto which the end portion of hose 45 is crimped. The end portion of hose 45 in this example is metal, enabling the crimping and sealing of hose 45 to body 47.

Body 47 has a receptacle 49 within it that receives a stationary valve seat 51. An oriface 53 extends coaxially through body 47 and valve seat 51. Body 47 has a set of internal threads 55 that receive a threaded portion of an end piece 57. Valve member 59 is carried within a cavity 60 in end piece 57. A spring 61, also contained in cavity 60 within end piece 57, urges valve 59 to a closed position. Valve member 59 has an oriface 63 for allowing fluid to flow inward from hose 45 into cavity 60 when the pressure of fluid in hose 45 is sufficient to unseat valve member 59. The inner end of cavity 60 is of smaller diameter and has a plurality of lateral outlets 67 for discharging flushing fluid from hose 45.

The upper end of the set of weight bars 41 attaches to end piece 57. The attachment could be made in a variety of ways. In this embodiment, the upper end of the uppermost weight bar 41 is attached by a pin 69 that passes through spaced apart ears 70 of the uppermost weight bar 41. Pin 69 allows the uppermost weight bar 41 to pivot in a single plane relative to nozzle 43.

Referring again to FIG. 1, injection assembly 33 includes a ram type blowout preventer 71 that will close around hose 45 to prevent flow of fluid from the well into injector assembly 33 in the event high well pressure is encountered. Also, a shearing type gate valve 73 can be actuated to sever hose 45 in the event of emergency. A conventional stuffing gland 74 seals around hose 45 as it moves through injector assembly 33. An injector head 75 grips hose 45 and pushes it downward in tubing 23 as well as pulling it upward within tubing 23. Injector head 75 is preferably powered, but a hand wheel 76 can optionally be used to move hose 45 as a backup. Hose 45 is preferably stored on a reel 77. A pump 79 pumps purging or cleansing fluid, such as water, from a reservoir or tank 81.

In the preferred operation, when sand has accumulated in tubing 23 above and within pump 15, the flow rate decreases and eventually the string of rods 21 may cease to be able to rotate rotor 19. To free pump 15, the operator installs injector assembly 33 as shown in FIG. 1, without removing gear box 29 or motor 31. The operator applies a selected fluid pressure that is sufficient to cause hose 45 to become stiff but less than required to open valve 59 (FIG. 3). The operator turns off motor 31 if rods 21 are still rotating, then actuates injector head 75, which causes hose 45 to move forward. The articulated weights 41 will contact rod 21 and the opposite side of bore 39 and deflect downward. The pressure within hose 45 with valve 59 closed provides sufficient rigidity to cause it to deflect and turn downward in tubing 23 as it contacts rods 23 adjacent port 28. The operator continues injecting hose 45 while maintaining fluid pressure below that which would open valve 59 until weights 41 reaches a desired level. This level could be only a short distance below tubing head 25, or the operator may choose to continue injecting hose 45 with valve 59 closed until movement stops, which could be when weight bars 41 contact an obstruction such as sand accumulation.

At the desired level, the operator increases the internal fluid pressure, causing valve member 59 (FIG. 3) to open. The water flows out through hose 45 and discharges from outlets 67 into tubing 23. The jetting of the water loosens impacted sand and causes the sand to flow to the surface along with the returning water. At the surface, the water and sand mixture flows out flow outlet 27. The operator optionally may continue moving hose 45 downward while jetting water out the lower end of hose 45. Once a substantial portion of the sand is removed, the operator retrieves hose 45 by reversing injecting head 75. After retrieval, the operator turns motor 31 back on to determine if sufficient sand has been removed to rotate rods 21. It may be necessary to repeat this procedure if too much sand remains in pump 15 or tubing 23.

The invention has significant advantages. The method allows one to clean sand from tubing without pulling the top drive motor assembly. Fluids other than water could be injected, if desired. The process of inserting the hose through a sidewall in the wellhead assembly and into the tubing could be used for other processes in addition to removing sand. The flexibility of the hose allows it to turn as much as a 90 degree corner in the wellhead assembly, thus a special-purpose wellhead assembly is not required.

While the invention has been shown in only some of its forms, it should be apparent to those skilled in the art that it is not so limited, but is susceptible to various changes without departing from the scope of the invention.

The invention claimed is:

1. A method of pumping a fluid into a string of tubing suspended from a wellhead within casing in a well, wherein the well contains a pump located at a lower end of the string of tubing that is rotated by a string of rods extending through the tubing to a motor assembly mounted to the wellhead, comprising:

(a) closing a lower end of an elastomeric hose and pumping a fluid into the hose while the lower end of the hose is closed to create internal pressure in the hose to increase rigidity of the hose;

(b) inserting the hose through a port in a sidewall of the wellhead and causing the hose to deflect and move downward from the port into the tubing alongside the string of rods; and (c) increasing the internal pressure in the hose to a level sufficient to cause the lower end of the hose to open, and discharging the fluid into the tubing.

2. The method according to claim 1, wherein step (a) further comprises attaching an articulated weight bar to the lower end of the hose.

3. The method according to claim 1, further comprising continuing to push the hose downward in the tubing while discharging the fluid out the lower end of the hose.

4. The method according to claim 1, further comprising retrieving the hose after step (c).

5. A method of cleaning debris from a string of production tubing suspended within casing in a well, wherein a rotary pump is located at a lower end of the tubing for pumping well fluid through the tubing to a wellhead at the surface, the pump being rotated by a string of rods extending through the tubing from the pump to a motor assembly at the wellhead, the wellhead having a port extending laterally therethrough that is in communication with an upper end of the tubing, the method comprising:

(a) placing a closure member on a lower end of an elastomeric hose that will open when a selected level of internal fluid pressure is applied, and pumping water into the hose to a pressure less than the selected level to increase rigidity of the hose;

(b) inserting the hose through the port and into contact with the string of rods extending upward through the tubing, the hose deflecting downward and into the tubing;

(c) pushing the hose downward in the tubing alongside the string of rods while maintaining internal fluid pressure in the tubing;

(d) at a desired depth, increasing the internal pressure in the hose to the selected level, thereby opening the closure member, and discharging water into the tubing, the water returning back up the tubing around the string of rods to the surface along with debris; then (e) pushing the hose farther downward from the desired depth and continuing to discharge water into the tubing to further clean debris from the tubing.

6. The method according to claim 5, wherein the desired depth of step (d) occurs when the lower end of the hose ceases to move downward in the tubing.

7. The method according to claim 5, wherein step (a) further comprises attaching an articulated weighs bar to the lower end of the hose.

8. The method according to claim 5, wherein step (e) comprises simultaneously discharging water out the closure member while pushing the hose downward.

9. In a well having a wellhead located at an upper end of a string of casing, a string of production tubing suspended within the casing, a rotary pump secured to a lower end of the tubing, a motor assembly mounted to the wellhead, a string of rods extending through the wellhead and the tubing from the motor assembly to the pump for rotating the pump to pump well fluid through the tubing around the string of rods to the wellhead at the surface, the wellhead having a port extending laterally therethrough that is in fluid communication with an upper end of the tubing, the improvement comprising:

an elastomeric hose extending through the port in the wellhead and into the tubing alongside the string of rods;

an injector head connected to the port of the wellhead for gripping the hose and pushing the hose downward in the tubing;

a closure member on the lower end of the hose that will open when a selected level of internal fluid pressure to the hose is applied; and a pump in fluid communication with an upper end of the hose for pumping fluid into the hose to stiffen the hose while being pushed by the injector head downward in the tubing and for opening the closure member and discharging the fluid into the tubing when desired.

* * * * *

UNITED STATES PATENT AND TRADEMARK OFFICE

CERTIFICATE OF CORRECTION

PATENT NO. : 7,069,995 B2
APPLICATION NO. : 10/825260
DATED : July 4, 2006
INVENTOR(S) : Kwong-Onn C. Chan et al.

It is certified that error appears in the above-identified patent and that said Letters Patent is hereby corrected as shown below:

In the Claims:

Column 5, line 20, delete "weighs" and insert --weight--

Signed and Sealed this

Twenty-first Day of November, 2006

JON W. DUDAS
*Director of the United States Patent and Trademark Office*